US008127565B1

(12) United States Patent
Lange et al.

(10) Patent No.: US 8,127,565 B1
(45) Date of Patent: Mar. 6, 2012

(54) REFRIGERATING DEVICE

(76) Inventors: Debra J. Lange, Cornell, WI (US); Daniel Lange, Cornell, WI (US)

( * ) Notice: Subject to any disclaimer, the term of this patent is extended or adjusted under 35 U.S.C. 154(b) by 553 days.

(21) Appl. No.: 12/403,010

(22) Filed: Mar. 12, 2009

(51) Int. Cl.
*A47F 3/04* (2006.01)

(52) U.S. Cl. ..... 62/246; 62/457.6

(58) Field of Classification Search ..... 62/246, 62/547.1, 547.5, 547.6, 547.7, 547.9, 458, 62/371; 220/592.18, 592.2, 915.1, 915.2; 426/109, 115, 524; 312/45, 236
See application file for complete search history.

(56) References Cited

U.S. PATENT DOCUMENTS 4,823,554 A 4/1989 Trachtenberg et al.
(Continued)

*Primary Examiner* — Mohammad Ali

(57) ABSTRACT

A refrigerating device for helping to keep food cool during an event such as a dinner party or picnic comprising a base having a compressor and cooling coil, a removable serving bowl which can be inserted into the base, and a first half-dome cover component and second half-dome cover component for covering the removable serving bowl when it is in the base. The cover components can be opened and closed to allow access to the food inside the serving bowl.

9 Claims, 6 Drawing Sheets

U.S. PATENT DOCUMENTS 5,511,700 A * 4/1996 Ouno ..... 222/481.5
5,718,124 A 2/1998 Senecal
5,782,094 A * 7/1998 Freeman ..... 62/3.6
6,050,438 A * 4/2000 Kovens et al. ..... 220/4.24
D445,647 S 7/2001 Ciesko et al.
6,295,820 B1 10/2001 Cauchy et al.
6,378,325 B1 4/2002 Yang
D492,403 S * 6/2004 Iddan et al. ..... D24/104
6,763,665 B2 * 7/2004 Clark et al. ..... 62/3.6
6,923,017 B2 * 8/2005 Dais et al. ..... 62/457.6
6,976,371 B2 12/2005 Gleason et al.
7,308,796 B1 12/2007 Eager
7,383,836 B2 * 6/2008 Klemming ..... 126/506
7,444,825 B2 * 11/2008 Miller et al. ..... 62/255
7,677,056 B2 * 3/2010 Panganiban ..... 62/457.4
RE41,295 E * 5/2010 Cauchy ..... 62/3.3
7,805,958 B2 * 10/2010 Bratcher ..... 62/420
7,954,666 B2 * 6/2011 Webster et al. ..... 222/51
2002/0036203 A1 * 3/2002 Stewart ..... 220/9.2
2003/0131566 A1 * 7/2003 Glucksman et al. ..... 53/432
2006/0216379 A1 * 9/2006 Chou ..... 426/115
2007/0125306 A1 * 6/2007 Beecher ..... 119/51.02
2008/0216507 A1 * 9/2008 Tremblay ..... 62/457.2

* cited by examiner

REFRIGERATING DEVICE

FIELD OF THE INVENTION

The present invention is directed to a device for cooling food. More particularly, the present invention is directed to a table-top refrigerating device for cooling food during parties, picnics, or other occasions.

BACKGROUND OF THE INVENTION

For social occasions such as dinner parties, picnics, barbeques, or other similar situations, it can be difficult to keep food chilled or cold as needed. Standard can be cumbersome and keep food cold only as long as the ice is present inside the cooler. The present invention features an improved refrigerating device for cooling food.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
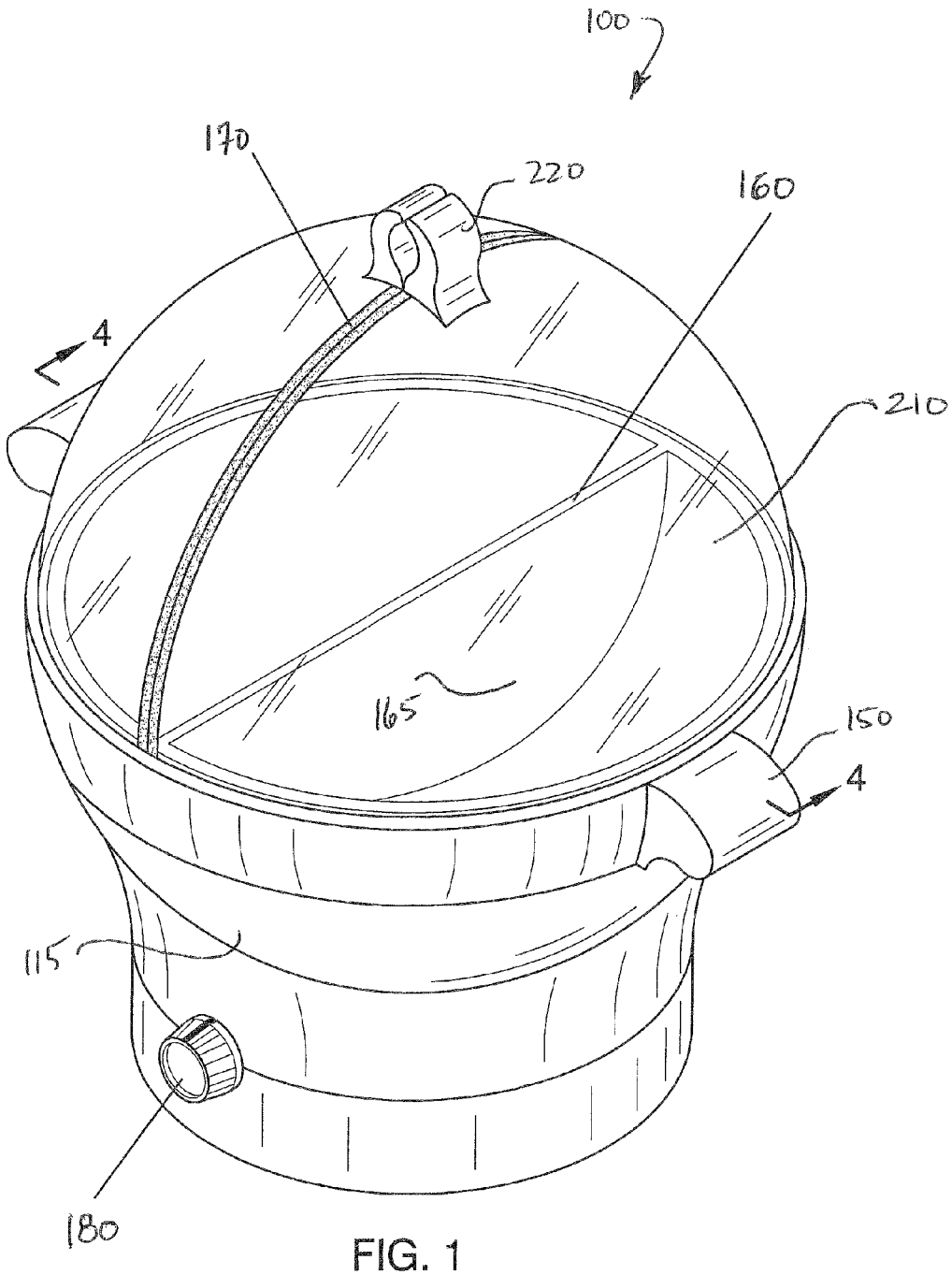
FIG. 1 is a perspective view of the refrigerating device of the present invention.

The following is a listing of numbers corresponding to a particular element referred to herein:

100 refrigerating device
110 base
111 first side of base
112 second side of base
113 top edge of base
114 bottom surface of base
115 front of base
116 back of base
130 top of base
135 cavity
150 base handle
160 removable serving bowl
165 wall
170 gasket
175 inner wall of base
180 control knob
190 first power cord
192 second power cord

Figure 2:
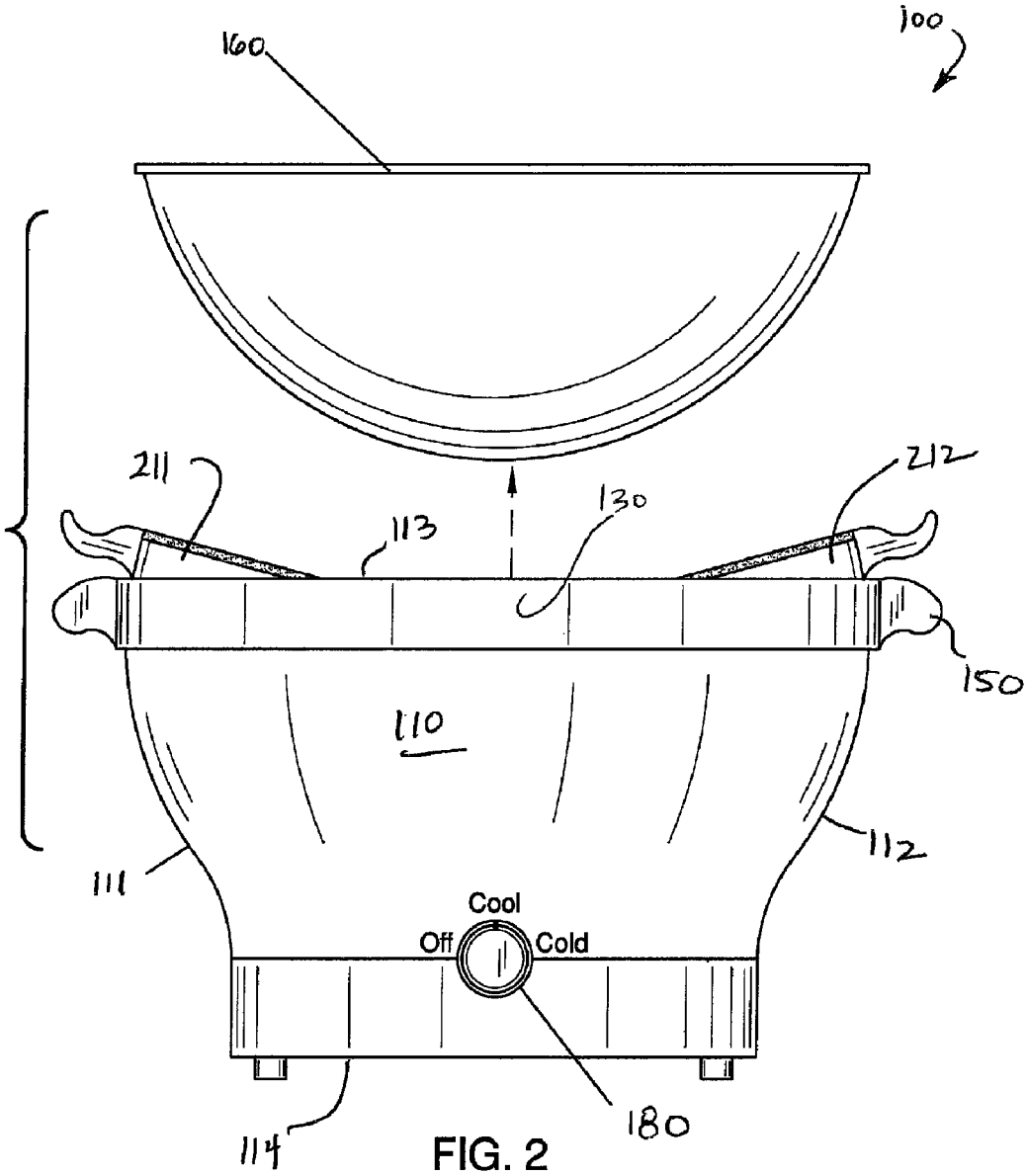
FIG. 2 is a front view of the refrigerating device of the present invention.
Figure 3:
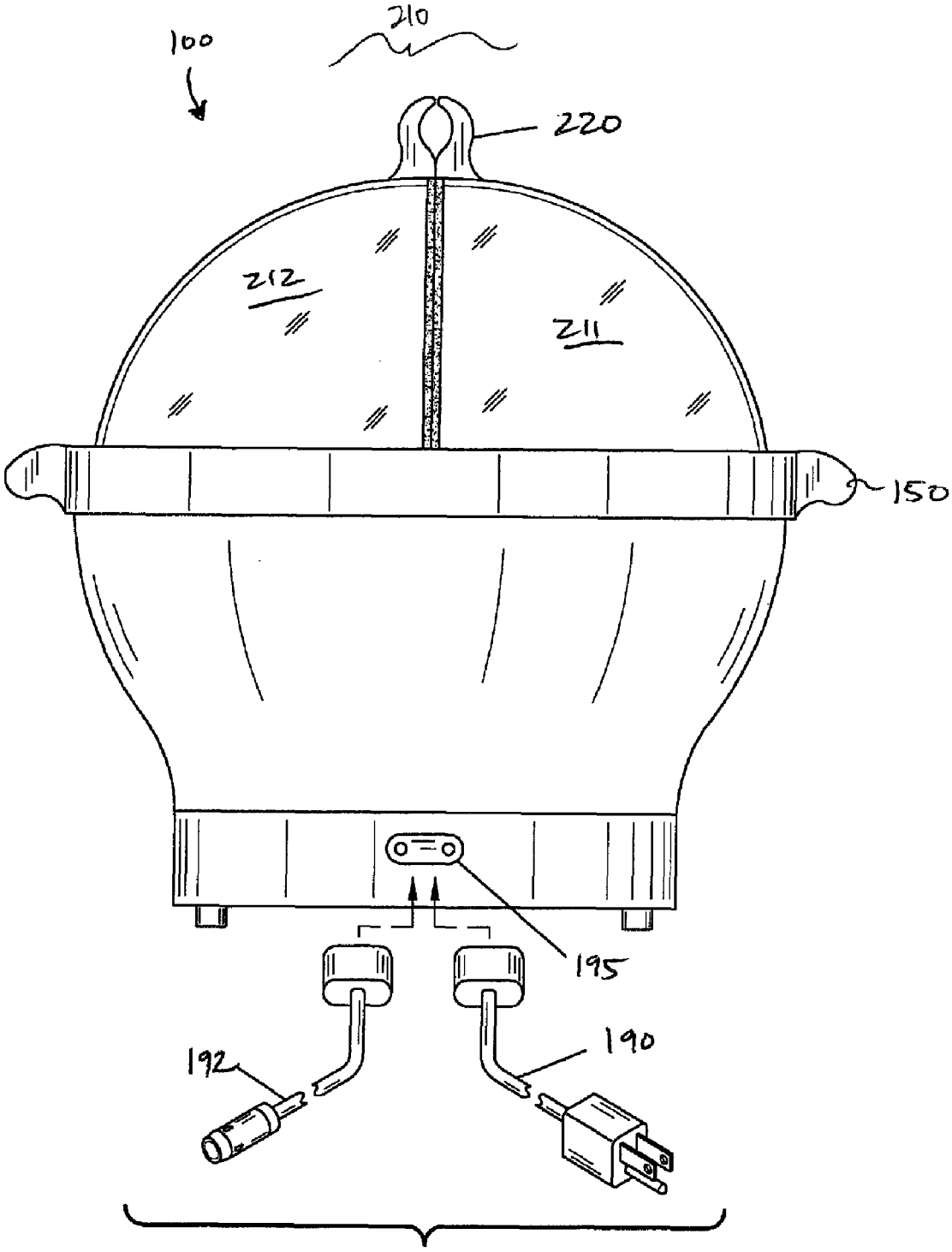
FIG. 3 is a back view of the refrigerating device of the present invention.
Figure 4:
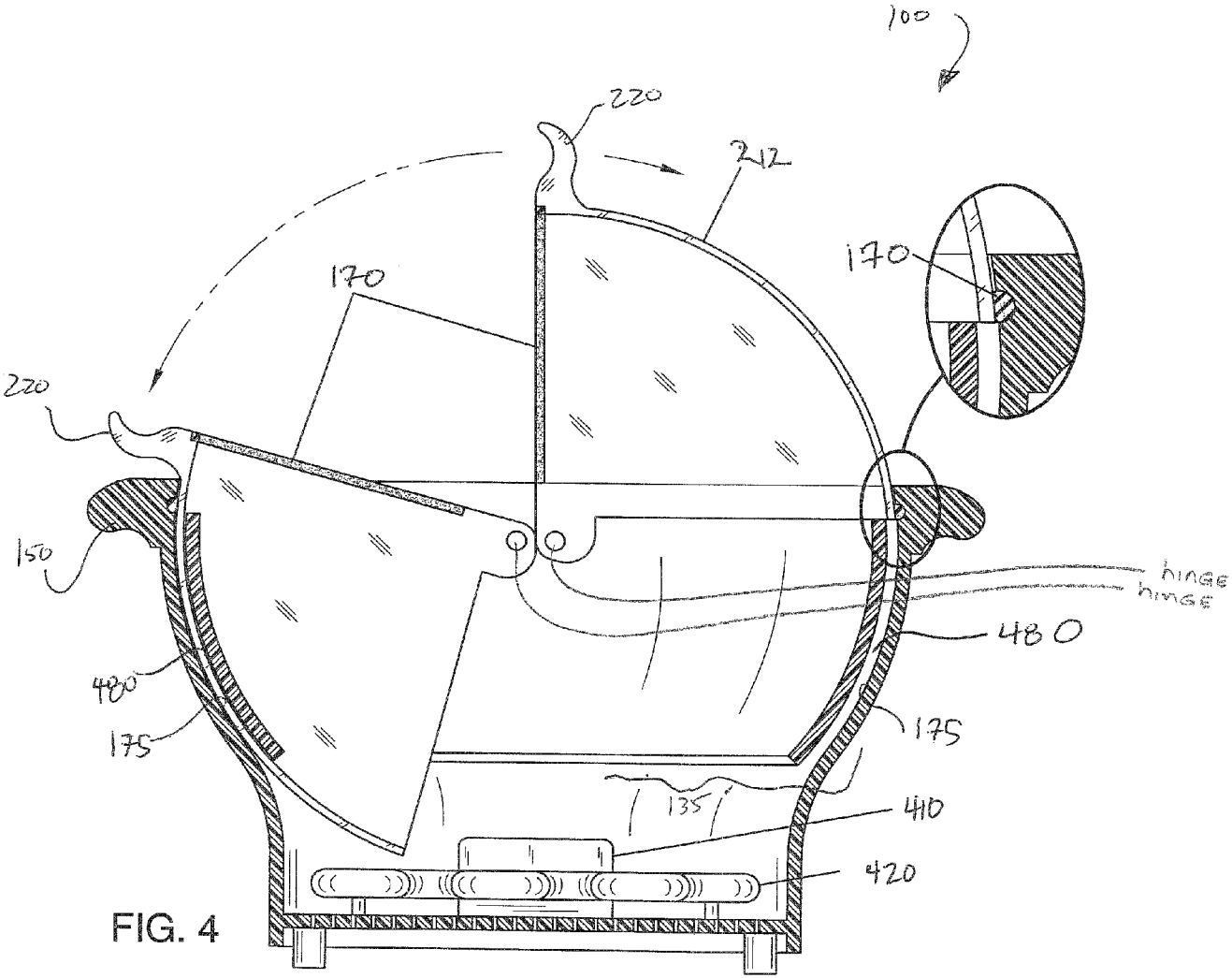
FIG. 4 is a front (or back) view of the first half-dome component and second half-dome component, including a front (or back) cross sectional view of the base and the bowl of the refrigerating device of the present invention.
Figure 5:
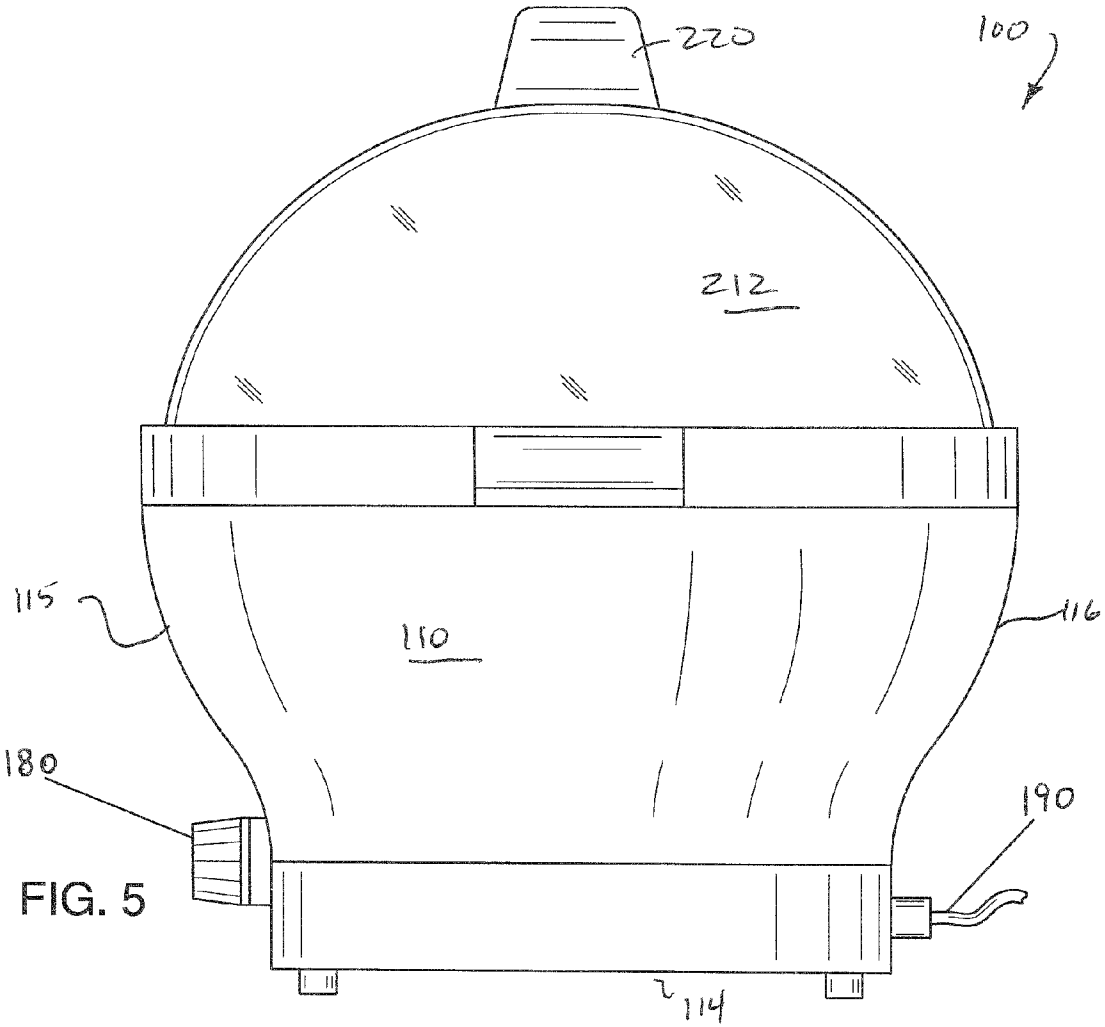
FIG. 5 is a side view of the refrigerating device of the present invention.
Figure 6:
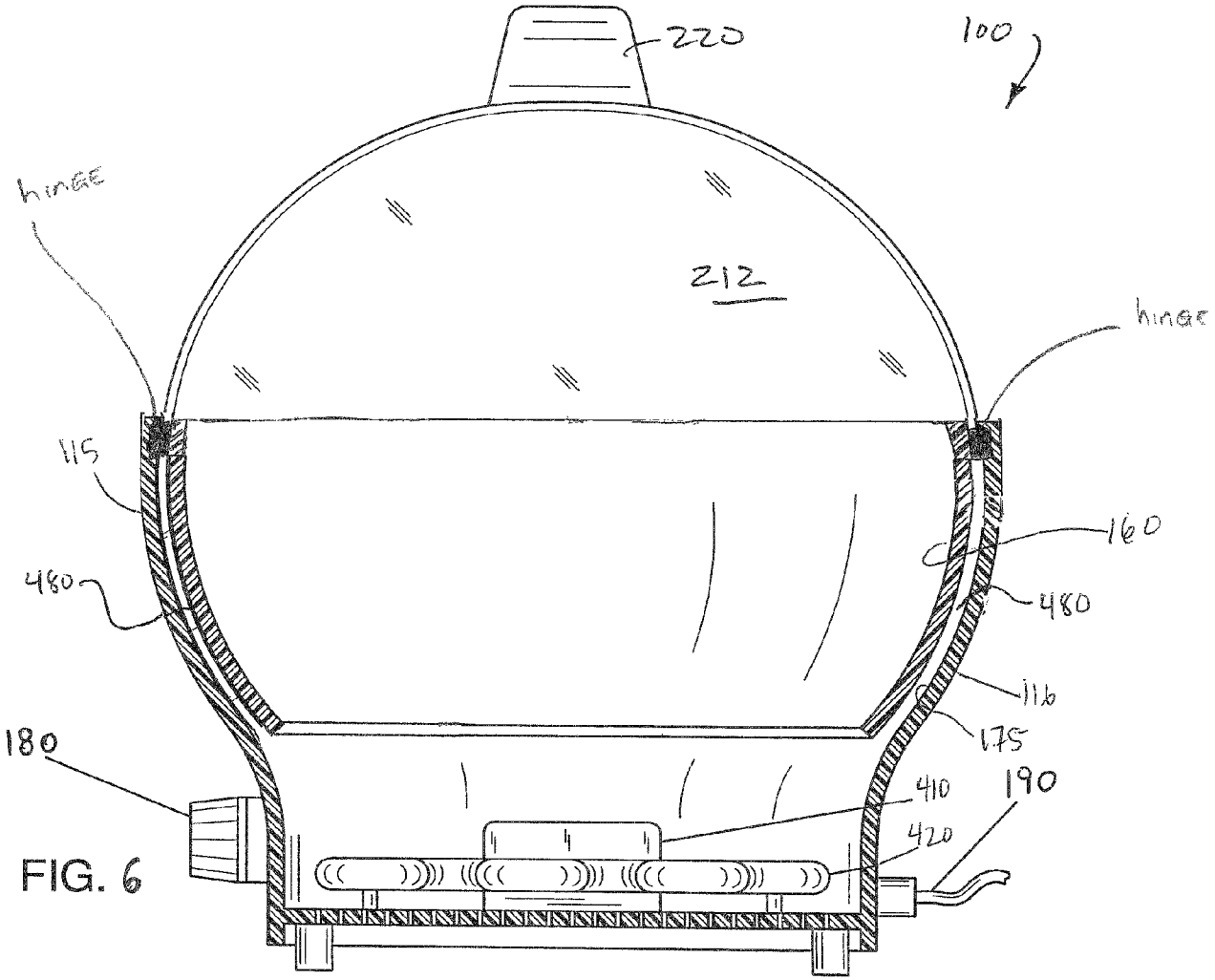
FIG. 6 is a side view of the second half-dome component including a side cross sectional view of the base and the bowl of the refrigerating device of the present invention.

195 cord receptacle
210 dome-shaped cover component
211 first half-dome cover component
212 second half-dome cover component
220 handle
410 compressor
420 cooling coil
480 slot Referring now to FIGS. 1-6, the present invention features a refrigerating device 100 for keeping food cold during parties, picnics, or other occasions. The refrigerating device 100 comprises a base 110 having a generally cylindrical shape having a first side 111, a second side 112, a top 130, a top edge 113, and a bottom surface 114. In some embodiments, the base 110 has a front side 115 and a back side 116. In some embodiments, the top 130 of the base 110 may have a larger diameter than the bottom surface 114. The base 110 is not limited to a generally cylindrical shape. In some embodiments, a base handle 150 is disposed on the base 110 (e.g., on the first side 111, second side 112) for allowing a user to pick up the refrigerating device 100.

A cavity 135 is disposed in the top 130 of the base 110. A removable serving bowl 160 can be inserted into the cavity 135 of the base 110. In some embodiments, when the bowl 160 is inserted into the cavity 135, a first slot 480 is formed between the bowl 160 and the inside wall 175 of the base 110 on the first side 111 and a second slot 480 is formed between the bowl 160 and the inside wall 175 of the base on the second side 112. In some embodiments, the removable serving bowl 160 is partitioned via one or more walls 165.

A first half-dome cover component 211 and a second half-dome cover component 212 together form a dome-shaped cover component 210 for covering the bowl 160. The first half-dome cover component 211 and the second half-dome cover component 212 are each pivotally attached to the base 110 such that the first half-dome cover component 211 can slide into the first slot 480 and the second half-dome cover component 212 can slide into the second slot 480. The first half-dome cover component 211 and second half-dome cover component 212 can be moved between an open position and a closed position. The first half-dome cover component 211 and second half-dome cover component 212 can each be moved independently. As the first half-dome cover component 211 and second half-dome cover component 212 are opened, the first half-dome cover component 211 and second half-dome cover component 212 slide into the base 110 via the first slot 480 and second slot 480, respectively (see FIG. 4).

A gasket 170 is disposed on both a side edge of the first half-dome cover component 211 and on a side edge of the second half-dome cover component 212. The gasket 170 helps to create a seal between the first half-dome cover component and the second half-dome cover component. In some embodiments, the seal helps to prevent cold air from leaking out of the dome-shaped cover component 210. In some embodiments, a gasket 170 is disposed at the intersection of the first half 211 and/or second half 212 and the top edge 113 of the base 110.

In some embodiments, a handle 220 is disposed on the top of the first half-dome cover component 211 and/or the second half-dome cover component 212. The handle 220 can help a user open or close the dome-shaped cover component 210.

In some embodiments, the first half-dome cover component 211 and the second half-dome cover component 212 are separated by a center wall.

The base 110 comprises components for cooling the contents of the removable serving bowl 160. In some embodiments, a compressor 410 and a cooling coil 420 is disposed in the base 110 below the removable serving bowl 160. The compressor 410 and/or cooling coil 420 is electrically/operatively connected to a power source. For example, in some embodiments, the power source is an electrical outlet, a battery, or other power source (e.g., a car battery). In some embodiments, a power cord connects the refrigerating device 100 to a power source. In some embodiments, a first power cord 190 connects the device 100 to an alternating current (AC) source. In some embodiments, a second power cord 192 connects the device 100 to a direct current (DC) source. In some embodiments, the power cord connects to the base 110 via a cord receptacle 195 (see FIG. 3).

In some embodiments, a control knob 180 is disposed on the base 110, for example on the front 115 of the base 110, the first side 111 or second side 112 of the base 110, or on the back 116 of the base 110. The control knob 180 can allow a user to turn the refrigerating device 100 on and off. In some embodiments, the control knob 180 comprises buttons to control the temperature (e.g., a cool setting, a cold setting). In some embodiments, an indicator light is illuminated when the refrigerating device is turned on.

The refrigerating device 100 of the present invention may be constructed in a variety of sizes. For example, in some embodiments, the top 130 of the base 110 is about 15 inches in diameter. In some embodiments, the top 130 of the base 110 is between about 5 to 10 inches in diameter. In some embodiments, the top 130 of the base 110 is between about 10 to 15 inches in diameter. In some embodiments, the top 130 of the base 110 is between about 15 to 25 inches in diameter. In some embodiments, the top 130 of the base 110 is more than about 25 inches in diameter.

As used herein, the term "about" refers to plus or minus 10% of the referenced number. For example, an embodiment wherein the base 110 is about 10 inches in diameter includes a base 110 that is between 9 and 11 inches in diameter.

The following the disclosures of the following U.S. patents are incorporated in their entirety by reference herein: U.S. Pat. No. 6,378,325; U.S. Pat. No. 7,308,796; U.S. Pat. No. 6,976,371; U.S. Pat. No. 6,295,820; U.S. Pat. No. 5,718,124; U.S. Pat. No. 4,823,554.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A refrigerating device for keeping food cold comprising:

(a) a generally cylindrical base having a first side, a second side, a top side, top edge, a bottom surface, and a cavity on the top side;

(b) a removable serving bowl for inserting into the cavity, wherein when the bowl is disposed in the cavity, a first slot is formed between the bowl and an inside wall of the base on the first side and a second slot is formed between the bowl and an inside wall of the base on the second side;

(c) a first half-dome cover component and a second half-dome cover component, the first half-dome cover component and the second half-dome cover component are each pivotally attached to the base such that the first half-dome cover component can slide into the first slot and the second half-dome cover component can slide into the second slot;

(d) a gasket disposed on both a side edge of the first half-dome cover component and on a side edge of the second half-dome cover component, wherein the gasket helps to create a seal between the first half-dome cover component and the second half-dome cover component;

(d) a cooling coil and a compressor disposed in the base near the bottom surface, wherein the cooling coil and compressor are for cooling an item in the removable serving bowl; and (e) a power source operatively connected to the cooling coil and the compressor.

2. The refrigerating device of claim 1, wherein a base handle is disposed on the first side of the base and on the second side of the base, wherein the base handle is for allowing a user to lift the refrigerating device.

3. The refrigerating device of claim 1, wherein the removable serving bowl is partitioned with one or more walls.

4. The refrigerating device of claim 1, wherein the first half and the second half can each be moved independently.

5. The refrigerating device of claim 1, wherein a handle is disposed on a top of the first half of the cover component and on a top of the second half of the cover component, wherein the handle is for helping a user open or close the cover component.

6. The refrigerating device of claim 1, wherein the first half and the second half are separated by a center wall.

7. The refrigerating device of claim 1, wherein the power source is an electrical outlet or a battery.

8. The refrigerating device of claim 1, wherein the power source is a car battery.

9. The refrigerating device of claim 1, wherein the refrigerating device further comprises a power cord for connecting the compressor and the cooling coil to the power source.

* * * * *